US006808405B1

(12) United States Patent
Uratani et al.

(10) Patent No.: US 6,808,405 B1
(45) Date of Patent: Oct. 26, 2004

(54) COAXIAL CONNECTOR AND COMMUNICATION DEVICE

(75) Inventors: Chikara Uratani, Kanazawa (JP); Takekazu Okada, Kanazawa (JP); Yuichi Maruyama, Kanazawa (JP); Yuichi Kushihi, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/794,058

(22) Filed: Mar. 8, 2004

(30) Foreign Application Priority Data

May 16, 2003 (JP) ..... 2003-138913

(51) Int. Cl.[7] ..... H01R 29/00
(52) U.S. Cl. ..... 439/188; 439/944; 439/39
(58) Field of Search ..... 439/188, 944, 439/38, 39, 63, 581; 200/51.1

(56) References Cited

U.S. PATENT DOCUMENTS 6,068,499 A * 5/2000 Kuriyama et al. ..... 439/188
6,146,168 A * 11/2000 Ishii ..... 439/188

FOREIGN PATENT DOCUMENTS

| | | |
|---|---|---|
| JP | 09-245907 | 9/1997 |
| JP | 10-003968 | 1/1998 |
| JP | 11-265761 | 9/1999 |
| JP | 2002-359032 | 12/2002 |

* cited by examiner

*Primary Examiner*—Tho D. Ta
(74) *Attorney, Agent, or Firm*—Keating & Bennett

(57) ABSTRACT

In a coaxial connector, signal lines are switched over by mounting and dismounting a probe having a central contact, and fixed yoke terminals, a movable terminal, and a permanent magnet constitute a magnetic circuit. When the probe is dismounted, the contact portions are connected by the magnetic force of the permanent magnet. When the probe is mounted, the contact portions are disconnected against the magnetic force such that the central contact pushes a protrusion portion of the movable terminal.

14 Claims, 9 Drawing Sheets

COAXIAL CONNECTOR AND COMMUNICATION DEVICE

BACKGROUND OF THE INVENTION

1. Field of the Invention

The present invention relates to a coaxial connector and a communication device, and more particularly to a coaxial connector for use in, for example, mobile communication devices such as portable telephones, etc., and to be able to change signal lines, and a communication device including such a coaxial connector.

2. Description of the Related Art

Up to now, in communication devices such as portable telephones, etc., there are cases in which a surface-mount type coaxial connector having a function for changing signal lines is used. The present applicant has proposed various coaxial connectors having such a switching function disclosed in Japanese Unexamined Patent Application Publication No. 9-245907, Japanese Patent No. 3064906, Japanese Unexamined Patent Application Publication No. 11-265761, Japanese Unexamined Patent Application Publication No. 2002-359032, and others.

As shown in FIG. 9, such a coaxial connector is basically constructed such that a movable terminal 92 made of a conductive thin plate, a fixed terminal 93, and an external terminal 94 are attached to an insulating case 91, and a contact portion 92*a* at the tip of the movable terminal 92 is arranged so as to be generally in contact with the contact portion 93*a* of the fixed terminal 93 by the elastic restoring force of the thin plate.

When a probe 80 for measuring characteristics is mounted, the central contact 81 is put in through the opening portion 95 of the insulating case 91, the movable terminal 92 is displaced downward by the central contact 81 (see the dotted line in FIG. 9), the contact portion 92*a* is disconnected from the contact portion 93*a*, and then the signal line is changed from the fixed terminal 93 to the central contact 81. At the same time, the external conductor 82 comes into contact with the external terminal 94, which is grounded.

On the other hand, a coaxial connector in which a magnetic force is utilized to perform a switching operation (changing signal lines) is described in Japanese Unexamined Patent Application Publication No. 2002-359032.

In a related coaxial connector 90 shown in FIG. 9, the opening and closing of the contact portions 92*a* and 93*a* are performed by the spring function of the movable terminal 92. Then, with a coaxial connector 90, which has a small size and a reduced height, it is difficult to obtain a sufficient stroke of the movable contact portion 92*a*. On the contrary, if a sufficient stroke is secured, the total length of the movable portion of a spring becomes larger and the contact pressure becomes smaller.

Accordingly, it is necessary to reduce the total length of the movable portion of a spring to a certain extent in order to secure a necessary contact pressure. However, in a short movable spring portion, plastic deformation may occur and the contacting reliability cannot be ensured. In order to prevent the plastic deformation, it may be considered to limit the stroke, but further shortening the originally small stroke makes the gap between the contact portions shorter, which may cause unstable disconnection.

On the other hand, in a coaxial connector using the magnetic force described in Japanese Unexamined Patent Application Publication No. 2002-359032, since a part of the magnetic circuit is made open, the efficiency of making use of the magnetic flux is not necessarily high.

SUMMARY OF THE INVENTION

In order to overcome the problems described above, preferred embodiments of the present invention provide a low-cost, compact coaxial connector, in which the efficiency of making use of the magnetic flux is high and the reliability of contacting of the movable terminal to the fixed terminal is excellent, and also provide a communication device including such a novel connector. Also, preferred embodiments of the present invention provide a low-cost, compact coaxial connector as described in the preceding sentence that also has a reduced number of parts, requires much fewer man-hours for production, and which can be produced at a greatly reduced cost, and also provide a communication device including such a novel connector. In addition, preferred embodiments of the present invention provide a low-cost compact coaxial connector as described in the preceding sentences, and which can prevent corrosion of the contact portions, increase and secure the reliability of contact, and have terminal portions thereof be reliably soldered, and also provide a communication device including such a connector.

According to a preferred embodiment of the present invention, a coaxial connector includes switching signal lines with a probe having a central contact and an external conductor, the probe being mounted thereto or dismounted therefrom, and including a first fixed yoke terminal made of a conductive magnetic material, a second fixed yoke terminal made of a conductive magnetic material, a movable terminal made of a conductive magnetic material, and a permanent magnet made of a ferromagnetic material. In the coaxial connector, the first fixed yoke terminal, the second fixed yoke terminal, the movable terminal, and the permanent magnet constitute a magnetic circuit, at least one mechanical contact portion is provided between the first and second fixed yoke terminals in the magnetic circuit, and the contact portion is connected by the magnetic force of the permanent magnet when the probe is dismounted and the contact portion is disconnected by the movable terminal being pressed by the central contact when the probe is mounted.

In the coaxial connector of a preferred embodiment of the present invention, a signal line is provided in the magnetic circuit defined by the first fixed yoke terminal, the second fixed yoke terminal, the movable terminal, and the permanent magnet so as to have at least one mechanical contact portion. This contact portion is changed to a connected state by the magnetic force of the permanent magnet to form a closed magnetic circuit, and, since the efficiency of using the magnetic flux is high, a stable connected state can be maintained. Then, since the contact portion is disconnected by the central contact pressing the movable terminal when the probe is mounted, the performance of the disconnection is reliable.

In a coaxial connector of a preferred embodiment of the present invention, when the contact portion is connected, the first fixed yoke terminal and the second fixed yoke terminal are electrically connected through the movable terminal and, when the contact portion is disconnected, the first fixed yoke terminal and the second fixed yoke terminal are electrically disconnected. The construction of the coaxial connector, in which the magnetic circuit and the signal line are combined into one, becomes compact, the number of parts and the number of man-hours required for manufacturing are also reduced, and it becomes possible to build the coaxial connector at low cost.

Furthermore, the contact portion being disconnected returns to the contact portion being connected by the magnetic force of the permanent magnet. Since the maintenance of the contact pressure and the return to the connected state from the disconnected state are performed by the magnetic force, even if the opening and closing of the contact portion are repeated, the contact pressure hardly changes and the opening and closing operation can be stably performed.

The permanent magnet has anisotropic magnetic characteristics. In the anisotropic permanent magnet, the flux centers on the magnetic pole surfaces and leakage of the magnetic flux is reduced. As a result, the contact pressure increases.

The first fixed yoke terminal and the second fixed yoke terminal are integrally provided with input-output terminals for an electrical signal. The number of parts and the number of man-hours required for production are reduced.

Furthermore, the direction of the magnetic flux passing through the movable terminal is substantially perpendicular to the magnetization direction of the permanent magnet. The movable terminal is disposed between the N pole and S pole of the permanent magnet and the movable contact portion is also positioned in the vicinity of the neutral point of the magnet. Accordingly, the movable terminal is prevented from being attracted by the magnet because of leakage of the magnetic flux and the movable contact portion reliably returns to a contacting state.

The magnetic flux passing through between the movable terminal and the first fixed yoke terminal or the second fixed yoke terminal may be larger than the magnetic flux passing through between the movable terminal and the permanent magnet. The movable contact portion reliably returns to a contacting state.

Moreover, the first fixed yoke terminal, the second fixed yoke terminal, and the movable terminal are nickel-plated as a foundation coat and are gold-plated as a top coat. A cold rolling steel plate is preferably used for cost-efficiency in these terminals, but corrosion of the terminals is prevented by nickel plating and gold plating, and the solderability and contact reliability increase.

Furthermore, a communication device according to another preferred embodiment of the present invention includes a coaxial connector according to the preferred embodiments of the present invention described above. Thus, the communication device has the advantages of the improved contact reliability of the coaxial connector and the other advantages described above.

Other features, elements, characteristics and advantages of the present invention will become more apparent from the following detailed description of preferred embodiments thereof with reference to the attached drawings.

BRIEF DESCRIPTION OF THE DRAWINGS

FIG. 5A is a sectional view of the coaxial connector in which no probe is mounted, and FIG. 5B is a sectional view of the coaxial connector in which a probe is mounted;

FIG. 7A is a top view thereof, FIG. 7B is a front view thereof in which the contact portion is connected, and FIG. 7C is a front view thereof in which the contact portion is disconnected;

DETAILED DESCRIPTION OF PREFERRED EMBODIMENTS

Hereinafter, preferred embodiments of a coaxial connector and a communication device according to the present invention are described with reference to the accompanied drawings.

Figure 1:
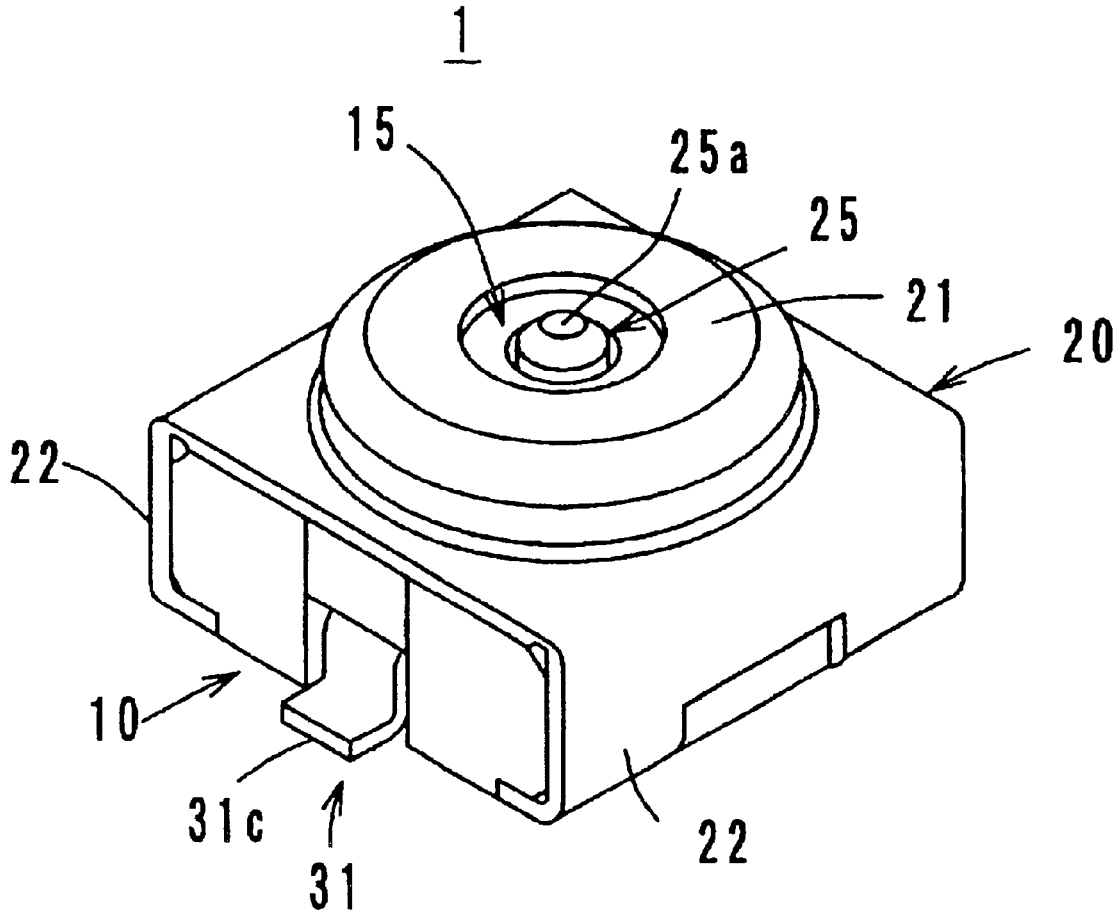
FIG. 1 is a perspective view of a coaxial connector according to a first preferred embodiment of the present invention.
Figure 2:
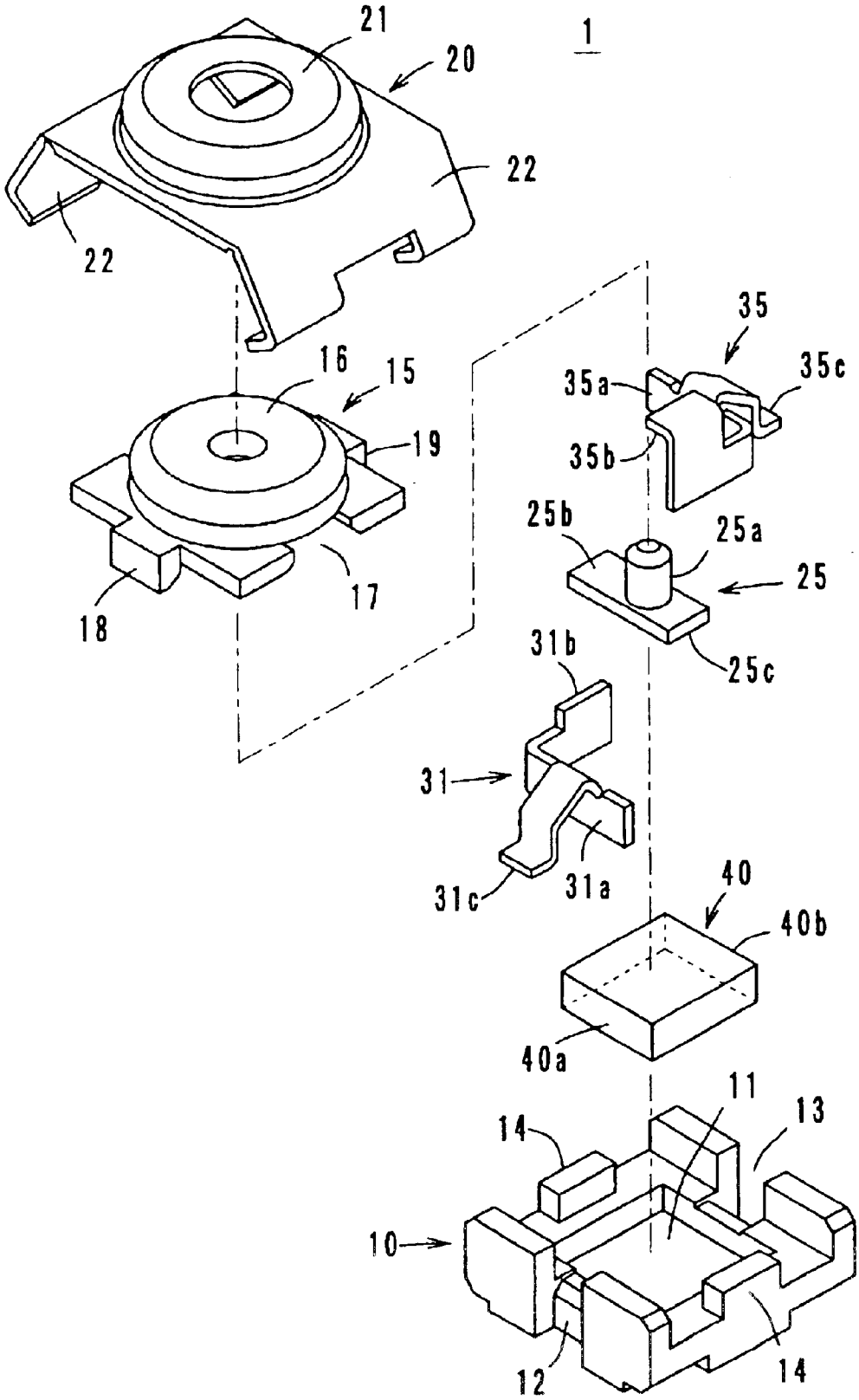
FIG. 2 is an exploded perspective view showing the coaxial connector in FIG. 1.

A coaxial connector according to a first preferred embodiment of the present invention, as shown in FIGS. 1 and 2, includes cases 10 and 15, an external terminal (ground terminal) 20, a movable terminal 25 functioning as a switching element for changing signal lines, fixed yoke terminals 31 and 35, and a permanent magnet 40.

In a probe 50, which is connected to the coaxial connector 1 in order to measure characteristics thereof, as shown in FIG. 5, an external connector 53 is provided around a central contact 51 through an insulating material 52.

The fixed yoke terminal 31, which is made of a magnetic material, is provided with a base portion 31*a* in contact with the permanent magnet 40, a contact portion 31*b* in contact with the movable terminal 25, and a signal input-output terminal 31*c*.

The fixed yoke terminal 35 made of a magnetic material is provided with a base portion 35*a* being in contact with the permanent magnet 40, a contact portion 35*b* being in contact with the movable terminal 25, and a signal input-output terminal 35*c*.

The movable terminal 25 made of a magnetic material is provided with a protrusion portion 25*a* which the lower end of the central contact 51 of the probe 50 makes contact with and breaks away from, a contact portion 25*b* which makes contact with the contact portion 31*b* of the fixed yoke terminal 31, and a contact portion 25*c* which makes contact with the contact portion 35*b* of the fixed yoke terminal 35.

Figure 3:
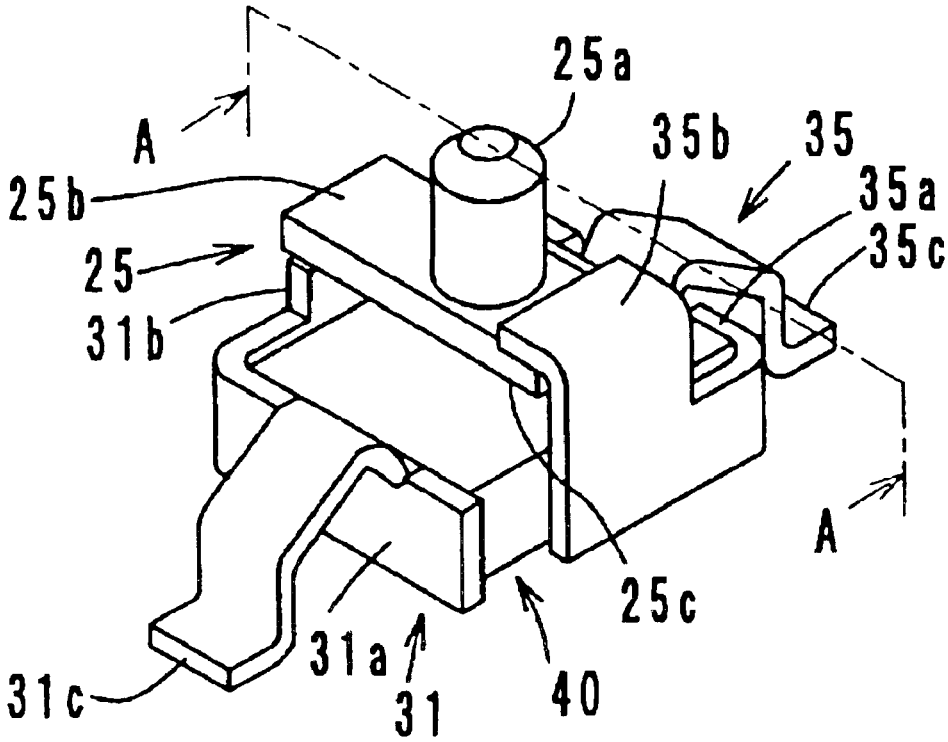
FIG. 3 is a perspective view showing the parts constituting a magnetic circuit in the coaxial connector shown in FIG. 1.
Figure 4:
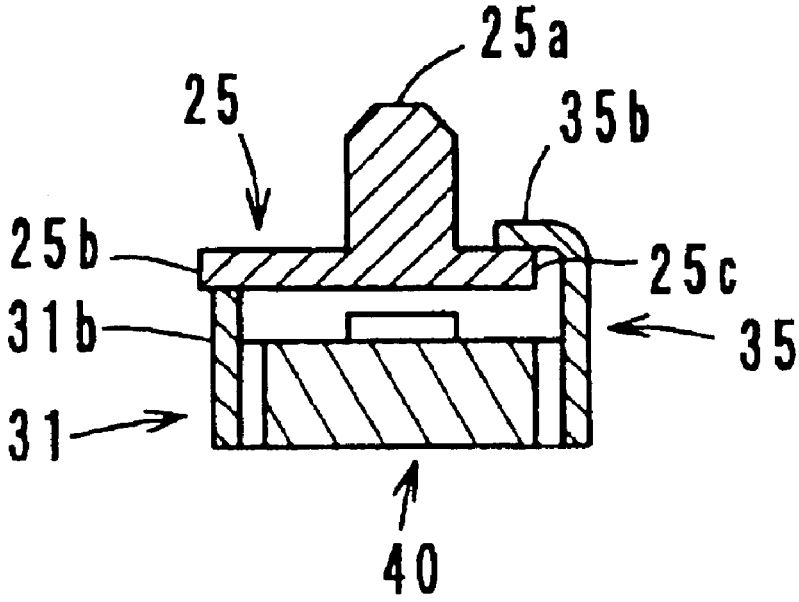
FIG. 4 is a cross-sectional view taken along line A-A of FIG. 3.

When the terminals 25, 31, and 35 and the permanent magnet 40 are assembled, as shown in FIG. 3, the base portions 31*a* and 35*a* of the fixed yoke terminals 31 and 35 come into contact with the magnetic pole surfaces 40*a* and 40*b* (see FIG. 2) of the permanent magnet 40. As shown in FIG. 4, because of the magnetic force of the permanent magnet 40, the contact portion 25*b* of the movable terminal 25 comes into contact with the contact portion 31*b* and the contact portion 25*c* comes into contact with the contact portion 35*b*, and thus a magnetic circuit is constructed.

The cases 10 and 15 are molded preferably by using a dielectric material. In the lower case 10, a concave portion 11 for accommodating the magnetic circuit including the permanent magnet 40 and the terminals 25, 31, and 35, and notch portions 12 and 13 for leading out the terminal portions 31*c* and 35*c* of the fixed yoke terminals 31 and 35 are formed.

In the cases 10 and 15, convex portions 14 and concave portions 17 which are joined for positioning the cases 10 and 15 are formed. In addition, in the upper case 15, a substantially cylindrical portion 16 for positioning the external terminal 20 and convex portions 18 and 19 for fixing the location of the terminal portions 31*c* and 35*c* of the fixed yoke terminals 31 and 35 without allowing looseness thereof are formed.

The external terminal 20 is formed such that a conductive thin plate is made substantially cylindrical by a drawing operation, etc., and a substantially cylindrical portion 21 being joined to the substantially cylindrical portion 16 of the case 10 and leg portions 22 and 23 are provided. This external terminal 20, as shown in FIG. 1, is arranged to sandwich the cases 10 and 15 having the magnetic circuit therein by the leg portions 22 and 22. The external terminal 20 functions as a ground terminal and, when the probe 50 is set, the upper edge portion of the substantially cylindrical portion 21 is in electrical contact with the end portion of the external conductor 53, constituting a probe contact surface, as shown in FIG. 5B.

Figure 5A:
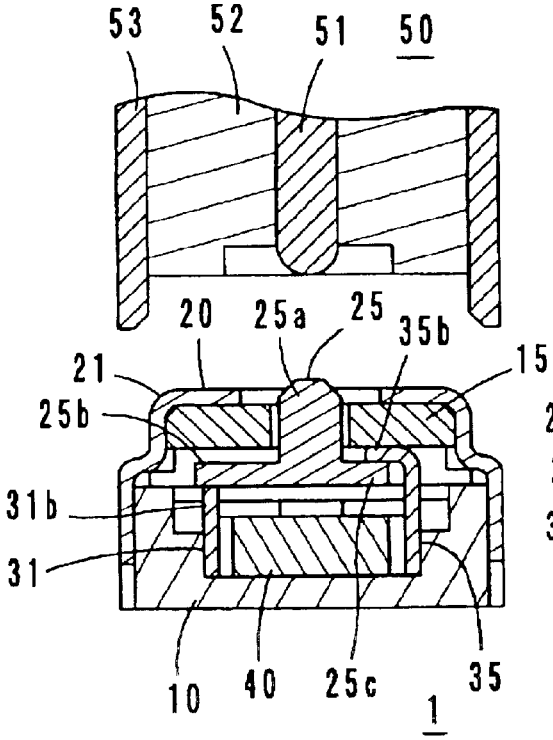
FIGS. 5A and 5B show the operation of the coaxial connector.

Furthermore, as shown in FIGS. 1 and 5A, the protrusion portion 25*a* of the movable terminal 25 is exposed above the substantially cylindrical portion 16 of the case 15 and the substantially cylindrical portion 21 of the external terminal 20.

Next, the operation of the coaxial connector 1 having the above structure is described. When the probe 50 is not set, the movable terminal 25 is as shown in FIG. 5A and this is in the same state as shown in FIG. 4. That is, due to the magnetic force of the permanent magnet 40, the contact portion 25*b* of the movable terminal 25 makes contact with the contact portion 31*b* of the fixed yoke terminal 31 and the contact portion 25*c* makes contact with the contact portion 35*b* of the fixed yoke portion 35. In this case, the fixed yoke terminals 31 and 35 are connected through the movable terminal 25 to constitute a signal line.

Figure 5B:
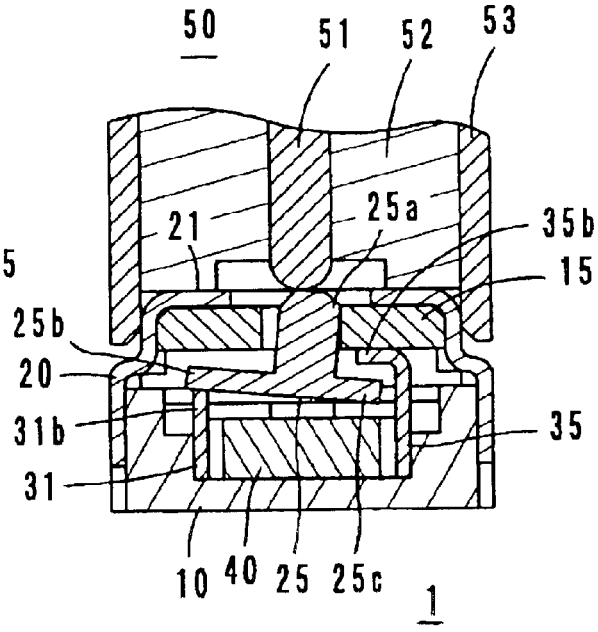

On the other hand, when the probe 50 is set to the coaxial connector 1, as shown in FIG. 5B, the tip of the central contact 51 presses on the protrusion portion 25*a* of the movable terminal 25. Because of this pressing force, the movable terminal 25 slightly pivots around the contact portion 31*b* of the fixed yoke terminal 31 as a supporting point against the magnetic force of the permanent magnet 40 and then the contact portion 25*c* breaks away from the contact portion 35*b* of the fixed yoke terminal 35. In this way, the signal line is changed to the central contact 51 through the movable terminal 25 from the fixed yoke terminal 35.

When the probe 50 is disconnected from the coaxial connector 1, the movable terminal 25 returns to the state shown in FIG. 5A due to the magnetic force of the permanent magnet 40, and the signal line is once again changed to the one between the fixed yoke terminals 31 and 35.

In the coaxial connector 1 having the above structure and operation, a signal line where a current flows in the magnetic circuit constructed by combining the movable terminal 25, the fixed yoke terminals 31 and 35, and the permanent magnet 40 is provided. Then, the contact portions 25*c* and 35*b* in the magnetic circuit are disconnected and connected as an opening and closing point (the contact portions 25*b* and 31*b* are normally closed) based on attaching and removing of the probe 50 by the magnetic force of the permanent magnet 40.

That is, since the opening and closing operation of the contact portions 25*c* and 35*b* are performed by the magnetic force of the permanent magnet 40 and does not depend on the spring action of the movable terminal as in the conventional devices, even if the stroke is short, a stable contacting state can be maintained and the connecting and disconnecting operation can be reliably performed. Furthermore, since the magnetic circuit and the signal line are made integral as a single unitary member, the coaxial connector 1 is made compact (small in size) and the number of parts and the number of man-hours required for assembly can be reduced, and, as a result, the coaxial connector 1 can be produced at lower cost.

Moreover, since the contact portion 25*c* of the movable terminal 25 in a disconnected state is connected to the contact portion 35*b* of the fixed yoke terminal 35 by the magnetic force of the permanent magnet 40, even if the opening and closing operation is repeated, the contact pressure does not change and a stable opening and closing operation can be performed.

Furthermore, since the input-output terminal portions 31*c* and 35*c* for an electrical signal are integrally formed in the fixed yoke terminals 31 and 35, the number of parts and the number of man-hours are reduced and the improvements required when the input-output terminal portions 31*c* and 35*c* are made separate from the fixed yoke terminals 31 and 35 are not necessary.

Additionally, a resin material is used in the cases 10 and 15 because of lower cost and easier processing and, when the cost and availability are considered, it is desirable to use one of LCP, PPS, and polyamid resin. Since the substantially cylindrical portion 21 in the external terminal 20 is produced by a drawing operation, it is desirable to use brass and cold rolling steel plate.

It is desirable to use a magnet having anisotropic magnetic characteristics for the permanent magnet 40. In an anisotropic permanent magnet 40, the magnetic flux concentrates on the pole surfaces 40*a* and 40*b* and leakage of the flux is reduced to increase the pressure of the contact portion. In addition, since the magnetic flux is utilized effectively, a small-sized permanent magnet 40 can be used and the magnetic circuit becomes compact, which contributes to reduction in size of the coaxial connector. Furthermore, the downsizing of the permanent magnet 40 also contributes to cost reduction.

Since the fixed yoke terminals 31 and 35 are formed by stamping, it is desirable to use a cold rolling steel plate in consideration of cost and availability of the material. Regarding the movable terminal 25, it is desirable to use a material having magnetic characteristics comparable to those of cold rolling steel plates and being appropriate for cutting or forging processing.

As for the terminal portions 31*c* and 35*c* of the fixed yoke terminals 31 and 35, the improvement of solderability at the mounting areas is needed. Furthermore, corrosion prevention of the contact portions 31*b* and 35*b* and the contact portions 25*b* and 25*c* of the movable terminal 25 is needed to improve the reliability of the contact therebetween. Accordingly, in the first preferred embodiment, for the terminals 31, 35, and 25, nickel-plating is preferably used as a foundation coat and gold-plating is preferably used as a top coat.

Figure 6:
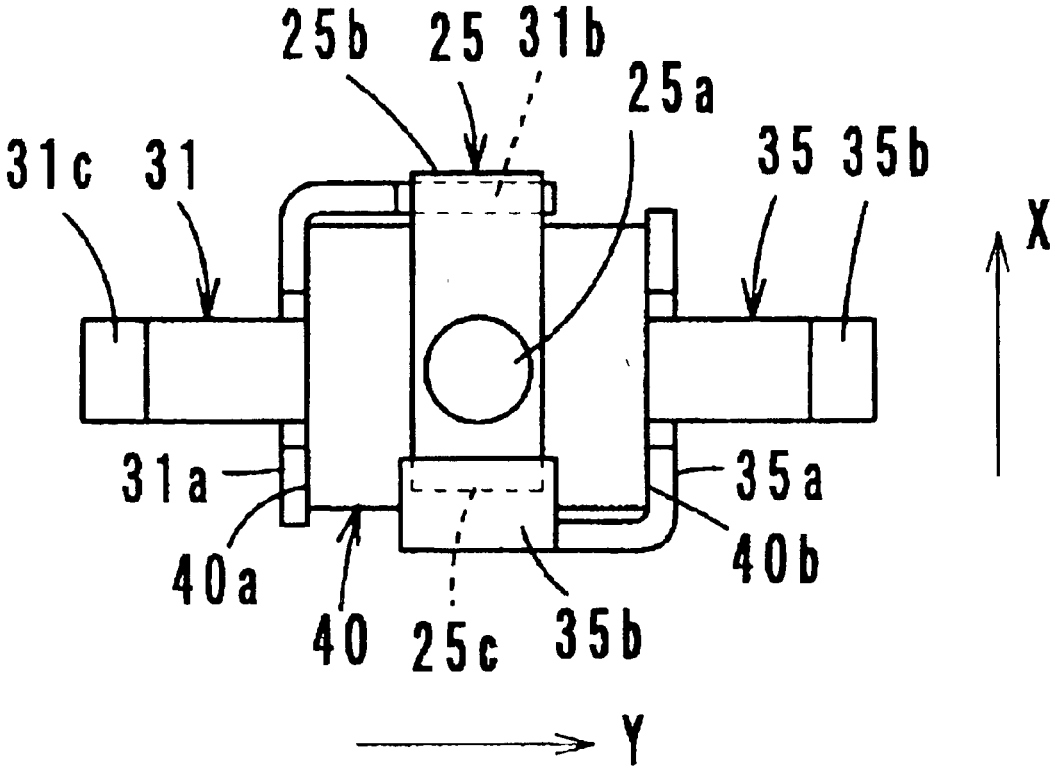
FIG. 6 is a top view showing the parts constituting the magnetic circuit in the coaxial connector in FIG. 1.

Now, in the present first preferred embodiment, as shown in FIG. 6, the base portions 31*a* and 35*a* of the fixed yoke terminals 31 and 35 face the magnetic pole surfaces 40*a* and 40*b*, and the contact portions 31*b* and 35*b* are bent to the sides of the permanent magnet 40 from the base portions 31*a* and 35*a*. The movable terminal 25 is arranged so as to bridge the contact portions 31*b* and 35*b*.

That is, the movable terminal 25 and the permanent magnet 40 are arranged such that the direction X of the magnetic flux passing through the movable terminal 25 and the magnetization direction Y of the permanent magnet 40 intersect at right angles. In this case, the movable terminal 25 is disposed at the middle point between the magnetic pole surfaces (N and S poles) of the permanent magnet 40. In other words, the contact portions 25*c* and 35*b* for opening and closing the signal line is located in the vicinity of the neutral point of the permanent magnet 40 and the attraction of the movable terminal 25 by the permanent magnet 40 due to leakage flux from the magnetic poles 40*a* and 40*b* can be prevented. Thus, the return to the state where the contact portion 25*c* is in contact with the contact portion 35*b* becomes satisfactory. Furthermore, such a construction leads to downsizing of the magnetic circuit.

Figure 7A:
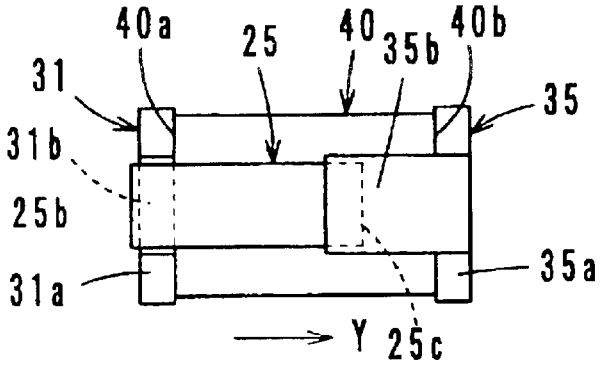
FIGS. 7A, 7B, and 7C show the parts constituting a magnetic circuit in a coaxial connector according to a second preferred embodiment of the present invention.
Figure 7B:
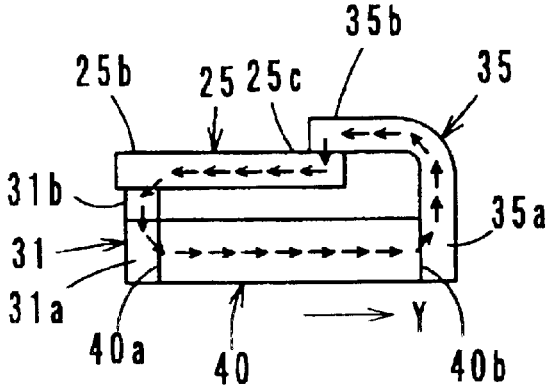
Figure 7C:
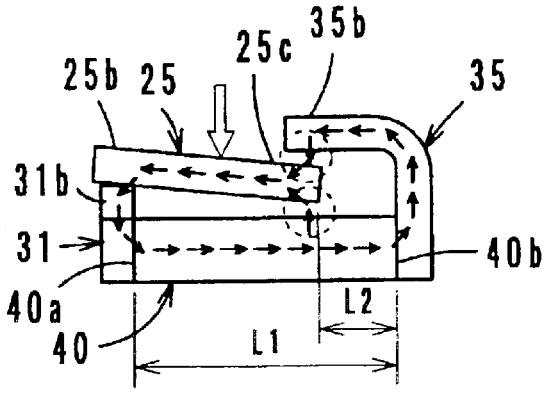

The second preferred embodiment is basically constructed in the same way by using the same parts as in the first preferred embodiment and overlapping explanation is omitted. What is different from the first preferred embodiment, as shown in FIG. 7, is the magnetic circuit formed by using the movable terminal 25, the fixed yoke terminals 31 and 35 and the permanent magnet 40. In FIG. 7, the arrows shown in the magnetic circuit represent vectors of the magnetic flux.

That is, the base portion 31*a* of the fixed yoke terminal 31 and the base portion 35*a* of the fixed yoke terminal 35 are in contact with the magnetic pole surfaces 40*a* and 40*b* of the permanent magnet 40 having anisotropic magnetic characteristics. Because of the magnetic force of the permanent magnet 40, the contact portion 25*b* of the movable terminal 25 is in contact with the contact portion 31*b* of the fixed yoke terminal 31 and the contact portion 25*c* is in contact with the contact portion 35*b* of the fixed yoke terminal 35 (see FIG. 7B). Then, the contact portions 25*c* and 35*b* are disconnected such that the central portion of the movable terminal 25 is pressed by the top of the central contact 51 of the probe 50 shown in FIG. 5 (see FIG. 7C).

In this magnetic circuit, the magnetization direction Y of the permanent magnet 40 is opposite to the direction of the magnetic flux passing through the movable terminal 25. Then, even if the contact portions 25*c* and 35*b* are disconnected, the magnetic flux passing through the contact portions 25*c* and 35*b* is larger than the flux passing between the contact portion 25*c* and the permanent magnet 40.

Such a relationship between the magnetic fluxes can be set such that the spaces L1 and L2 between the magnetic pole surfaces 40*a* and 40*b* and the contact portions 25*c* and 35*b* are increased as much as possible. Theoretically, when an anisotropic permanent magnet 40 is used, leakage of the magnetic flux does not occur away from the magnetization direction of the permanent magnet 40. However, leakage of the magnetic flux actually occurs away from the magnetization direction. In particular, when there is a gap in the magnetic circuit (in the case when the contact portions 25*c* and 35*b* are disconnected), since the contact portion 25*c* of the movable terminal 25 comes close to the permanent magnet 40, the magnetic flux flowing from the permanent magnet 40 to the movable terminal 25 increases, which is considered to cause the leakage of the magnetic flux.

Because of that, in order that the position of the contact portion 25*c* of the movable terminal 25 to the permanent magnet 40 may be separated from the magnetic pole surface 40*b* as much as possible and that adverse effects of leakage of the magnetic flux may be minimized, the spaces L1 and L2 are required to be larger. Accordingly, when a magnetic circuit where a sufficiently large space L2 is secured can be constructed, the return to the state where the contact portions 25*c* and 35*b* are in contact with each other becomes excellent in the present second preferred embodiment.

Figure 8:
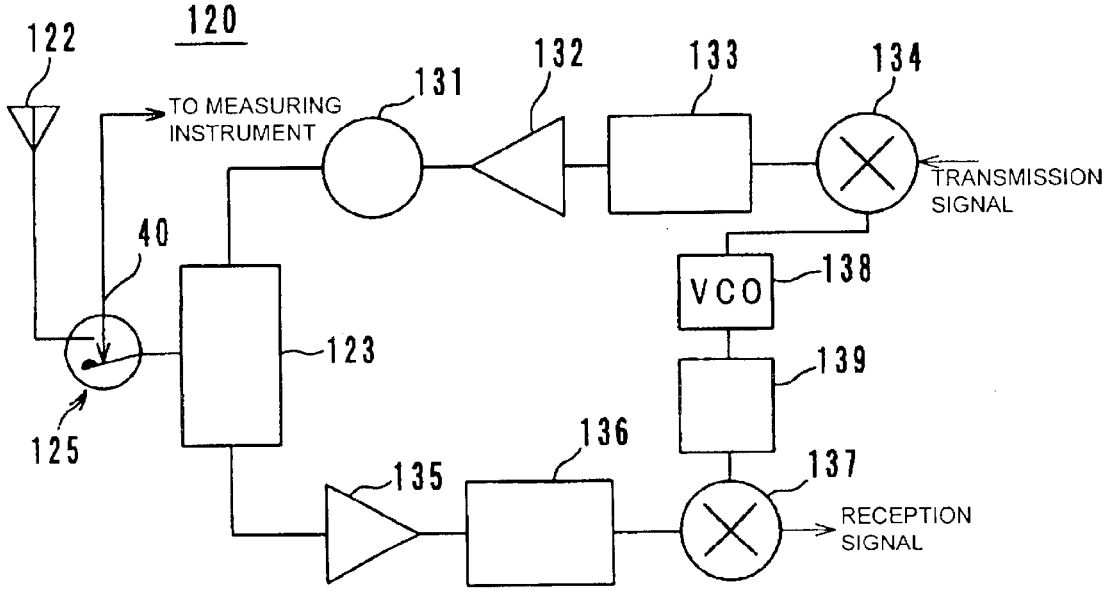
FIG. 8 is a block diagram showing a high-frequency circuit of a communication device (portable telephone) according to another preferred embodiment of the present invention.
Figure 9:
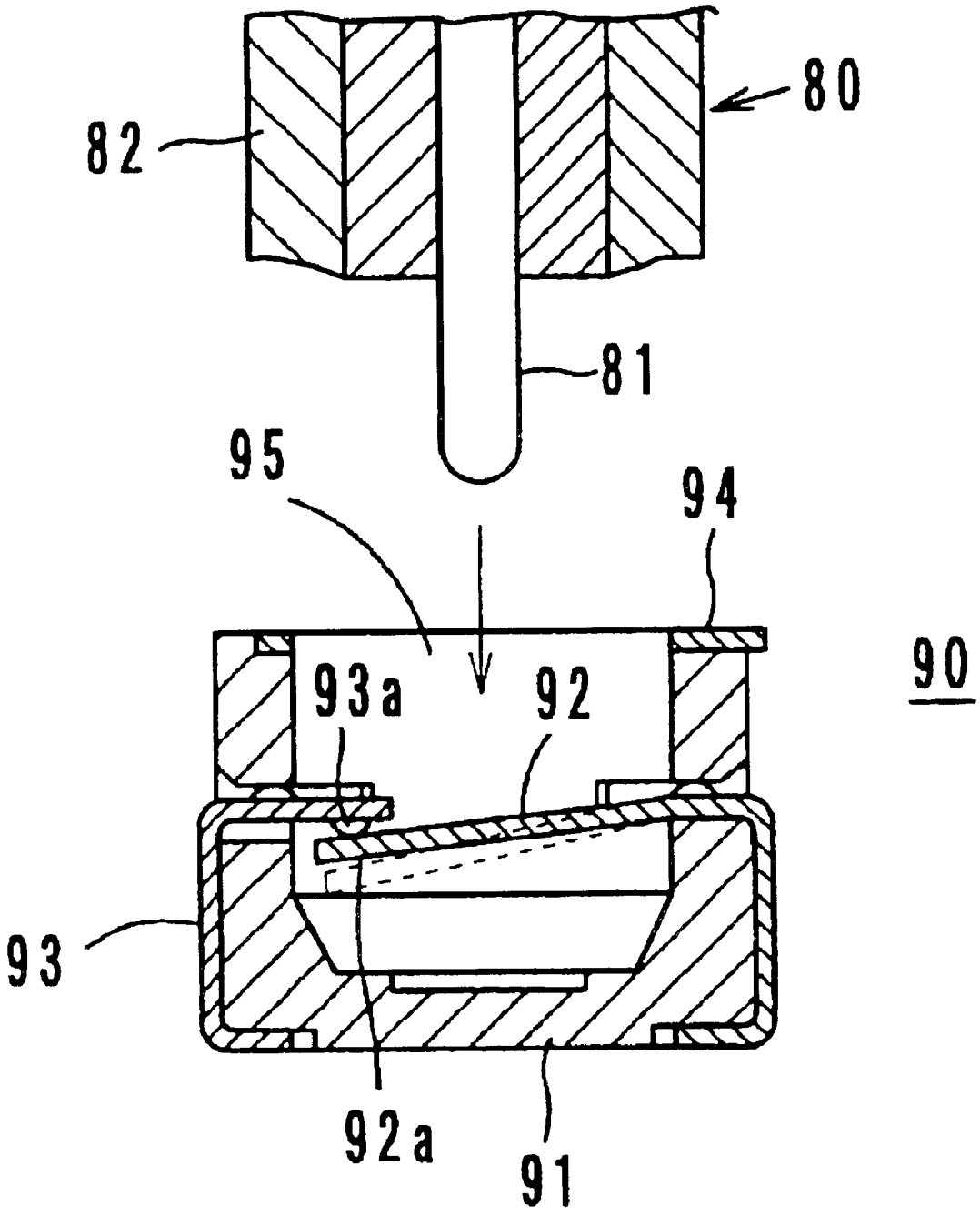
FIG. 9 PRIOR ART
FIG. 9 is a sectional view of a related coaxial connector in which no probe is mounted.

Next, a preferred embodiment of a communication device according to the present invention is described. FIG. 8 shows a high-frequency circuit 120 for a portable telephone. The high-frequency circuit 120, provided with an antenna element 22, preferably includes a duplexer 123, a circuit changing switch 125, a transmission-side isolator 131, a transmission-side amplifier 132, a transmission-side interstage bandpass filter 133, a transmission-side mixer 134, a reception-side amplifier 135, a reception-side interstage bandpass filter 136, a reception-side mixer 137, a voltage-controlled oscillator (VCO) 138, and a local bandpass filter 139.

Here, the coaxial connector 1 can be used as a circuit changing switch 125. For example, when the electrical characteristics of the high-frequency circuit 120 are checked in the assembling process of portable telephones at a device manufacturer, a signal line to the antenna element 122 from the high-frequency circuit 120 can be switched to the side of a measuring apparatus by mounting the probe 50 connected to the measuring apparatus into the coaxial connector 1.

A coaxial connector and a communication device according to the present invention are not limited to the above-described preferred embodiments and can be varied and modified in various ways without departing from the spirit and the scope of the invention.

For example, the structure of the cases, the external terminal, the movable terminal, the fixed yoke terminals, and the permanent magnet constituting a coaxial connector is optional and can be changed as desired. Furthermore, the coaxial connector can be used in various communication devices in addition to portable telephones.

As is clearly understood from the above description, according to a coaxial connector of preferred embodiments of the present invention, since a signal line is formed by providing at least one mechanical contact portion in a magnetic circuit which is constructed by using a first fixed yoke terminal, a second fixed yoke terminal, a movable terminal, and a permanent magnet, the efficiency of making use of the magnetic flux is high, the contact portions can maintain stable contacting states, and the operation of connection and disconnection is ensured.

Furthermore, since a communication device of the present invention is provided with a coaxial connector having the above-described unique structure and characteristics, a communication device having greatly improved reliability is provided.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

What is claimed is:

1. A coaxial connector, switching signal lines with a probe having a central contact and an external conductor, the probe being mounted thereto or dismounted therefrom, the coaxial connector comprising:

a first fixed yoke terminal made of a conductive magnetic material;

a second fixed yoke terminal made of a conductive magnetic material;

a movable terminal made of a conductive magnetic material; and a permanent magnet made of a ferromagnetic material; wherein the first fixed yoke terminal, the second fixed yoke terminal, the movable terminal, and the permanent magnet constitute a magnetic circuit;

at least one mechanical contact portion is located between the first and second fixed yoke terminals in the magnetic circuit; and the at least one mechanical contact portion is connected by the magnetic force of the permanent magnet when the probe is dismounted and the at least one mechanical contact portion is disconnected by the movable terminal being pressed by the central contact when the probe is mounted.

2. A coaxial connector as claimed in claim 1, wherein, when the at least one mechanical contact portion is connected, the first fixed yoke terminal and the second fixed yoke terminal are electrically connected through the movable terminal and, when the at least one mechanical contact portion is disconnected, the first fixed yoke terminal and the second fixed yoke terminal are electrically disconnected.

3. A coaxial connector as claimed in claim 1, wherein the magnetic force of the permanent magnet changes the at least one mechanical contact portion being disconnected to the at least one mechanical contact portion being connected.

4. A coaxial connector as claimed in claim 1, wherein the permanent magnet has anisotropic magnetic characteristics.

5. A coaxial connector as claimed in claim 1, wherein the first fixed yoke terminal and the second fixed yoke terminal are integrally provided with input-output terminals for an electrical signal.

6. A coaxial connector as claimed in claim 1, wherein a direction of the magnetic flux passing through the movable terminal is substantially perpendicular to a magnetization direction of the permanent magnet.

7. A coaxial connector as claimed in claim 1, wherein the magnetic flux passing through an area between the movable terminal and the first fixed yoke terminal or the second fixed yoke terminal is larger than the magnetic flux passing through an area between the movable terminal and the permanent magnet.

8. A coaxial connector as claimed in claim 1, wherein the first fixed yoke terminal, the second fixed yoke terminal, and the movable terminal are nickel-plated to define a foundation coat and are gold-plated to define a top coat.

9. A coaxial connector as claimed in claim 1, wherein the first fixed yoke terminal has a base portion in contact with the permanent magnet, a contact portion in contact with the movable terminal, and a signal input-output terminal.

10. A coaxial connector as claimed in claim 1, wherein the second fixed yoke terminal has a base portion in contact with the permanent magnet, a contact portion in contact with the movable terminal, and a signal input-output terminal.

11. A coaxial connector as claimed in claim 1, wherein the movable terminal has a protrusion portion which a lower end of the central contact of the probe makes contact with and breaks away from, a first contact portion which makes contact with the first fixed yoke terminal, and a second contact portion which makes contact with the second fixed yoke terminal.

12. A communication device comprising a coaxial connector as claimed in claim 1.

13. A coaxial connector as claimed in claim 1, further comprising first and second cases for housing the coaxial connector, the first and second cases having convex and concave portions formed therein.

14. A coaxial connector as claimed in claim 13, wherein the first case has a substantially cylindrical portion for positioning the external conductor and convex portions for fixing a location of terminal portions of the first and second fixed yoke terminals.

* * * * *